US006328622B1

(12) United States Patent
Geery

(10) Patent No.: US 6,328,622 B1
(45) Date of Patent: Dec. 11, 2001

(54) SUBMERSIBLE WATER TOY

(76) Inventor: Daniel J Geery, Box 36, Basalt, ID (US) 83218

( * ) Notice: Subject to any disclaimer, the term of this patent is extended or adjusted under 35 U.S.C. 154(b) by 0 days.

(21) Appl. No.: 09/429,218

(22) Filed: Oct. 7, 1996

(51) Int. Cl.[7] ..... A63H 3/26

(52) U.S. Cl. ..... 446/153; 244/25; 244/96; 114/332; 273/140

(58) Field of Search ..... 244/25, 30, 31, 244/95, 97; 114/332; 446/153; 273/140, 487, 488, 457

(56) References Cited

U.S. PATENT DOCUMENTS

| | | |
|---|---|---|
| 23,163 | 3/1859 | Gage . |
| 43,419 | 7/1864 | McDougall . |
| 77,850 | 5/1868 | Stone . |
| 152,414 | 6/1874 | Rhone . |
| 280,914 | 7/1883 | De Souza . |
| 344,718 | 6/1886 | Campbell et al. . |
| 510,492 | 12/1893 | Sunovski . |
| 1,180,366 | 4/1916 | Asbury . |
| 1,324,961 | 12/1919 | Grantham . |
| 1,818,138 | 8/1931 | Howland . |
| 1,827,548 | 10/1931 | Studer . |
| 1,855,695 | 4/1932 | Snyder . |
| 2,108,093 | 2/1938 | Zimmerman . |
| 2,430,820 | 11/1947 | Lightfoot . |
| 2,826,001 | 3/1958 | Presnell . |
| 3,157,145 | 11/1964 | Farris et al. . |
| 3,613,615 | 10/1971 | Sturm . |
| 3,677,212 | 7/1972 | Gregoire . |
| 4,261,534 | 4/1981 | Roseli . |
| 5,090,636 | 2/1992 | Sadowski . |
| 5,351,991 | 10/1994 | Neumayr . |
| 5,425,515 | 6/1995 | Hirose . |
| 5,518,205 | 5/1996 | Wurst et al. . |
| 5,865,662 | 2/1999 | Dammann . |

*Primary Examiner*—Galen L. Barefoot
(74) *Attorney, Agent, or Firm*—Morriss, Bateman O'Bryant & Compagni

(57) ABSTRACT

A submersible water toy comprises a buoyant streamlined body and a pair of wings attached thereto. While the body encourages the vehicle to rise in water, the wings, being formed from thin flat members resist vertical movement while providing little resistance to forward motion. The centerline of the wings is positioned behind the center of gravity of the bode so that the vehicle will rise in a forward direction while the wings resist vertical movement. Upon release, the submerged water toy will glide at relatively high speeds in a forward direction while slowly rising to the surface.

19 Claims, 11 Drawing Sheets

SUBMERSIBLE WATER TOY

BACKGROUND

1. Field of the Invention

This invention relates to water toys and more specifically to a water toy that is capable of gliding through water upon being submerged and released by a user.

2. Background of the Invention

One patent reference known in the art discussing some of the basic concepts utilized by the present invention appears to be U.S. Pat. No. 43,419 obtained by Dr. Solomon Andrews, in 1864, describing "a mode by which the air may be navigated, and a new and useful machine by which it may be done."

Andrews observed that a plank rising in water does not rise vertically, but shoots off at a sidewise angle; and he developed an airship that did the same. By valving the hydrogen lifting gas, Andrews was able to glide laterally back down to earth; by thrusting ballast overboard, he could rise up again, much as balloonists still do, but all the while gliding up or down at some oblique angle.

A simple illustration of the fundamental principle can be produced by releasing a wooden yardstick underwater in a flat position, with a slight rise from horizontal. Upon release, the yardstick will shoot out laterally, even though it will thereafter equilibrate and, if the depth be great enough, reverse direction and begin ascending in the opposite direction.

Dr. Andrews' primary claim deals with: "the conversion to the perpendicular motion of a balloon or aerostat into a forward or horizontal motion, by means of the construction or form thereof, so as to make it ascend and descend on inclined planes in the atmosphere."

After a century and a quarter, Andrews' invention has not been improved upon, in spite of intense international interest in modes "by which the air may be navigated," world wide fascination with "flying saucers," and a hundred years of global interest in dirigibles and submarines. Even a multi-million dollar effort by the Aereon Corporation of New Jersey, in the late 1960s and early 70s, dedicated originally to improving Andrews-type vehicles did not succeed in the endeavor. In fact, the entire subject of floating and sinking does not appear to have been expanded upon in any significant way since the original precepts were set forth by Archimedes, in 250 BC.

Thus, it would be desirable to provide a means for converting perpendicular motion into lateral motion, particularly in a submersible underwater vehicle. Such a device would be particularly enjoyable to utilize in swimming pools and other bodies of water which are used for recreation where people engage in water sports or other activities. Furthermore, the present invention can be formed from off-the-shelf materials. In addition to use as a toy, the present invention may also play a significant role in ocean research and protection.

SUMMARY OF THE INVENTION

The present invention involves the construction and use of a vehicle that can glide under water without the need for propulsion devices. Further objects and advantages of these improvements for DCVs include the following, without being limited thereto:

It is an object of the present invention to utilize lateral and fore-aft center of gravity balancing mechanisms.

It is another object of the present invention to utilize resistive surfaces to enhance fore-aft equilibrium.

It is still another object of the present invention to employ flat and flat-tending surfaces to maximize resistance to vertical movement and improve the vehicle's lateral propulsive reaction with the medium.

It is yet another object of the present invention to reduce drag through aerodynamic streamlining.

Still another object of the invention is to reduce or eliminate standard controls, such as fins, rudders, stabilizers, and ailerons, along with their attendant drag.

Another object of the present invention is to use new materials that are light weight and have relatively high strength.

It is a further object of the present invention to provide arrangements which better balance the forces operating on a vehicle in accordance with the present invention, including but not necessarily limited to: center of gravity, center of buoyancy, vehicular balance in fore-aft and lateral directions, and resistive and reactive surface effects.

Further objects and advantages of my invention will become apparent from the accompanying drawings and descriptions.

DETAILED DESCRIPTION OF THE PREFERRED EMBODIMENTS

Extensive testing has revealed little distinction in the relative performance between air and water models of a given gross shape. Since this is consistent with the accepted principle that performance in one medium may be reasonably inferred from performance in other mediums, and given that this invention deals essentially with the gross shape of these vehicles, the more obvious construction differences between air, water, or other medium traveling embodiments have not been elaborated on. Additionally, to avoid verbosity, terms such as "aerostat," "air," or "aerodynamically streamlined" herein pertain also to other mediums, such as water or carbon dioxide.

Figure 1:
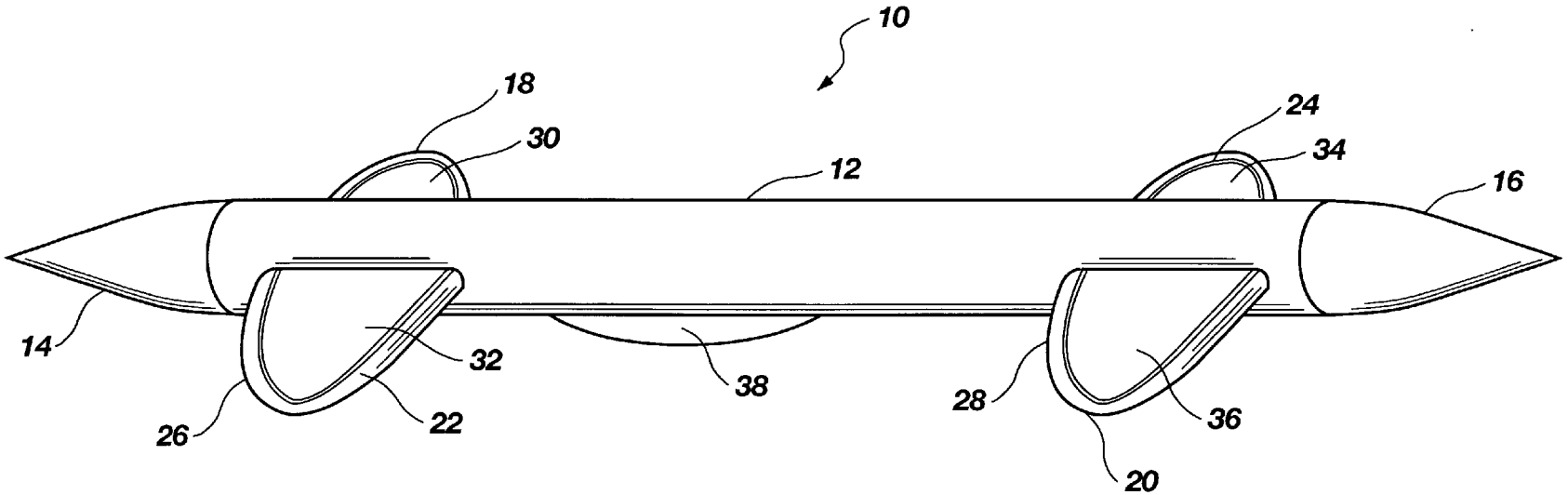
FIG. 1 is a perspective view of a first preferred embodiment of a vehicle in accordance with the principles of the present invention.

FIG. 1 illustrates a first preferred embodiment of a vehicle, generally indicated at 10 in accordance with the principles of the present invention. Any "ideal embodiment," however, must derive from the purpose or desired function of the vehicle, and further refinement of the particular arrangements involved. Thus while the vehicle 10 will work well in rapid linear transit, for example, it would not necessarily be best for hovering that might be desired in environmental monitoring, or in rescue or military vehicles that demand stabilization above a given spot, or for remotely controlled vehicles making multiple deliveries of cargo.

The main body 12 of the vehicle 10 shown in FIG. 1 is preferably comprised of 1¼ inch PVC pipe, 24 inches long; snug-fitting wood nose cones 14 and 16, tapering to 3 inch points, sealed with putty or caulk (not shown); and ¼ inch thick balsa wood wings 18 and 20 beveled 22 and 24 around the edges 26 and 28, respectively, rear wings 20 measuring 3 by 3 inches, fore wings 18 at 3-½ by 1-⅞ inches.

The vehicle 10 of this description is less dense than water, which results in buoyancy upon submersion. When the vehicle 10 is held two or three degrees off horizontal and released, its lateral movement and accentuated horizontal glide, deriving from buoyancy and reactive wing surfaces 30, 32, 34, and 36, become self-evident. Given an appropriate glide path, as for example from the deep end of a swimming pool, the inherent stability of the vehicle 10 also becomes apparent. The velocity of the vehicle 10, with relatively small buoyancy, is about 5 miles per hour.

The vehicle 10 is also provided with an optional stabilizing fin or rudder 38 attached to the body 12 and substantially longitudinally aligned with the longitudinal axis of the body 12. The fin or rudder 38 is preferably positioned closer to the rear wings 20 to help stabilize the path of the vehicle 10 similar to the vanes on an arrow.

Scale does not appear to greatly affect the functioning of this or other embodiments, except that the larger the scale the less susceptible any vehicle will be to local medium variations, such as turbulence. Also, as a rule, the larger the vehicles size, the greater its lift and capacity for increased payload. Likewise, the larger the lift, after gross weight is subtracted, the more reaction against the medium, and hence the greater the propulsive force and terminal velocity, all else being equal. The preferred embodiments shown in FIGS. 2 through 9 are proportionately equivalent to several models previously constructed and found to work well. Precise dimensions for particular embodiments remain a matter of fitting the vehicle to the purpose for which it is intended, fine tuning, and practical refinements. These embodiments, while illustrating the principles of the present invention, are not inclusive of over a thousand models built and flown to date, including heavier and lighter-than-water, and heavier and lighter-than-air (HTA and LTA) embodiments, nor should they limit improvements in DCVs in accordance with the principles of the present invention.

Figure 2:
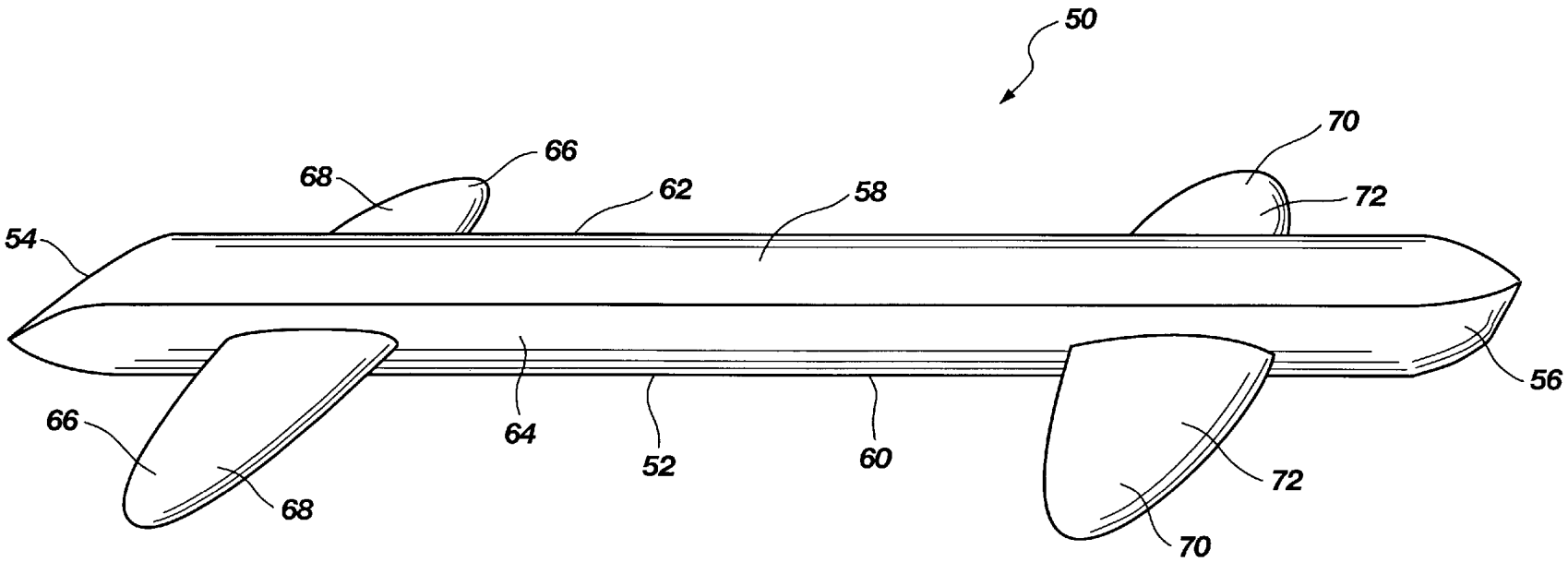
FIG. 2 is a perspective view of a preferred embodiment of a vehicle in accordance with the principles of the present invention.

FIG. 2 illustrates a second preferred embodiment of a vehicle, generally indicated at 50, in accordance with the principles of the present invention. The vehicle 50 is comprised generally of an elongate body 52 having tapered ends 54 and 56. The body 52 has a generally box-like shape with flat top side 58, bottom side 60, right side 62 and left side 64 with the top and bottom sides 58 and 60 curving at their ends to form the tapered ends 54 and 56.

The vehicle 50 is provided with a first pair of wings 66 and a second pair of wings 70. The first and second pairs of wings 66 and 70, respectively, are each attached to the body 52 by methods and means known in the art. The wings 66 and 70 each are configured to have the shape of an airfoil and thus have "flat-tending" surfaces 68 and 72, respectively. As illustrated, the wings 66 and 70 may have different shapes, widths, and cross-sectional areas, and thus need not be identical. As discussed in detail, herein, acceleration of the vehicle 50 may be accomplished by changing the center of gravity of the vehicle 50 to encourage one of the ends 56 or 54 to rise or fall, and depending on the buoyancy of the vehicle 50 will cause the vehicle to rise or fall.

Figure 3:
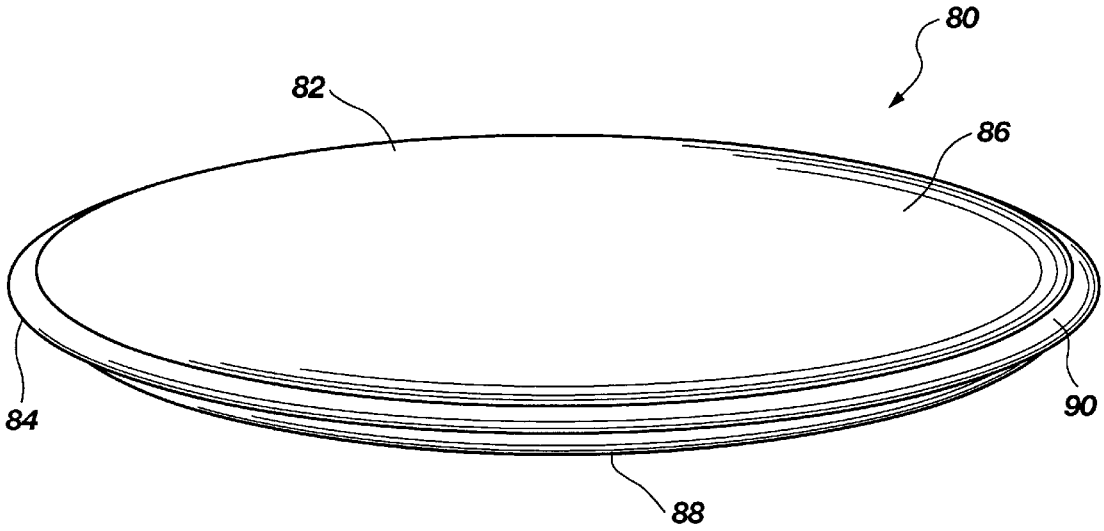
FIG. 3 is a perspective view of a third preferred embodiment of a vehicle in accordance with the principles of the present invention.

FIG. 3 illustrates yet another preferred embodiment of a vehicle 80 in accordance with the present invention. The vehicle 80 is comprised of a disc or saucer-shaped body 82 having a generally circular perimeter 84. The body 82 has a generally flat top surface 86 and a generally flat bottom surface 88. A beveled or tapered outer rim 90 interconnects the top and bottom surfaces 86 and 88, respectively. The saucer-shaped vehicle 80 is capable of traveling through fluid mediums, depending on its buoyancy or lack thereof by varying the angle of attack of the vehicle 80 as by modifying the center of gravity of the vehicle.

Figure 4:
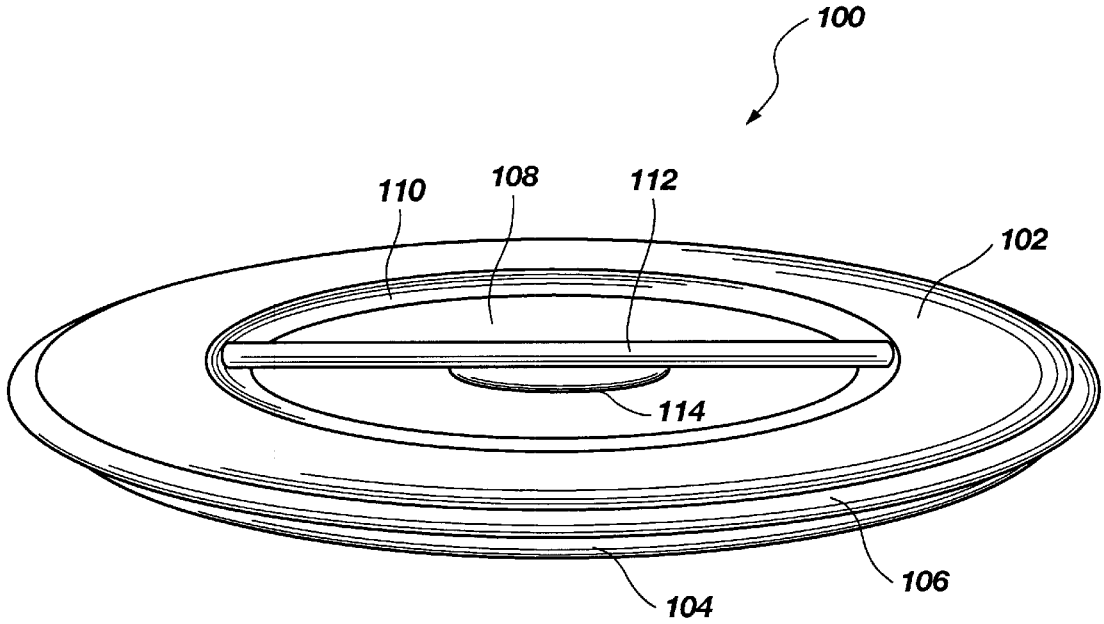
FIG. 4 is a perspective view of a fourth preferred embodiment of a vehicle in accordance with the principles of the present invention.

Referring now to FIG. 4, a vehicle, generally indicated at 100, is similar to the vehicle 80 illustrated in FIG. 3 having a substantially flat top surface 102, a substantially flat bottom surface 104 and a tapered outer ring 106 that interconnects the top and bottom surfaces 102 and 104, respectively. The vehicle 100, while being saucer-shaped similar to the vehicle 80 in FIG. 3, defines a center aperture 108 such that the vehicle 80 forms a substantially circular ring. The inner surface 110 of the vehicle 100 that defines the inner aperture 108 is beveled for aerodynamics and has a center strut or stabilizing bar 112 that spans the center aperture 108 along a diameter of the vehicle 100. The elongate strut 112 is further provided with a lateral stabilizing fin 114 configured for maintaining the trajectory of the vehicle 100 in a line parallel to the longitudinal axis of the fin 114.

Figure 5:
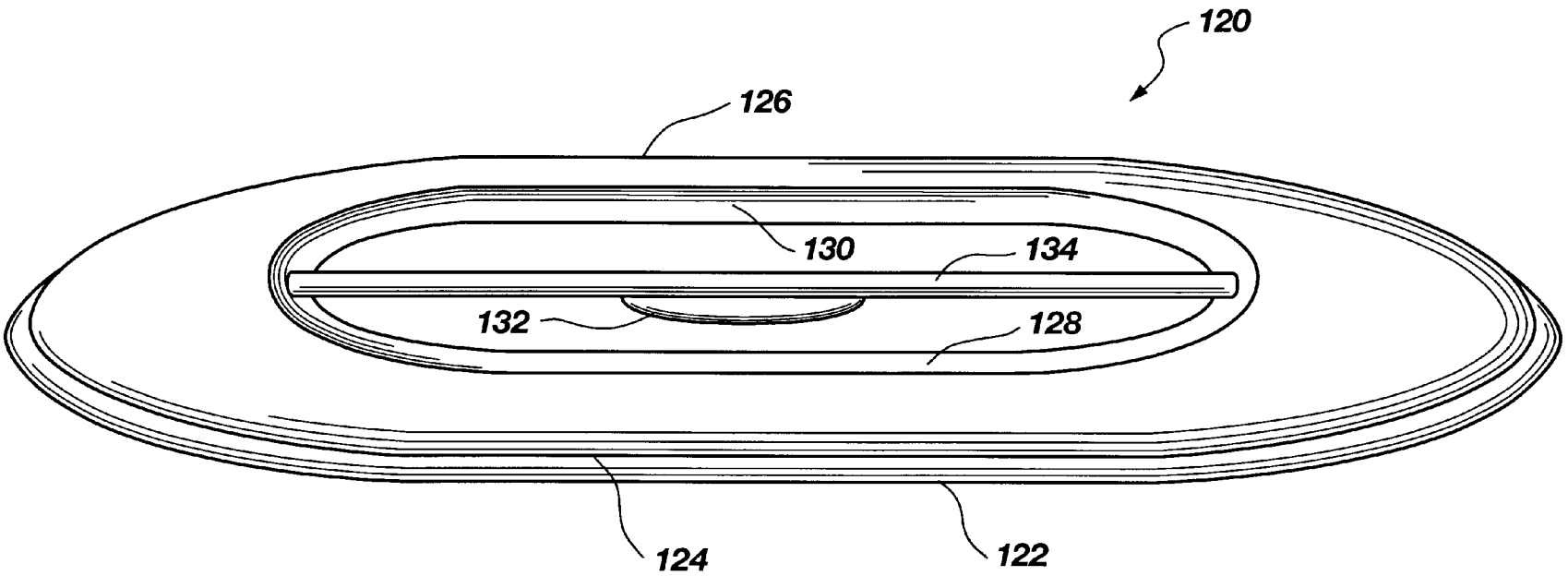
FIG. 5 is a perspective view of a fifth preferred embodiment of a vehicle in accordance with the principles of the present invention.

FIG. 5 illustrates yet another preferred embodiment of a vehicle, generally indicated at 120, having a similar configuration to the vehicle 100 illustrated in FIG. 4. The vehicle 120, however, is comprised of an elliptical or elongate body 122 as if the diameter of the vehicle 100 of FIG. 4 was maintained while the vehicle 100 were stretched lengthwise along the longitudinal axis of the fin 114 or strut 112. As such, the aerodynamic properties of the vehicle 120 are maintained while providing the vehicle 120 with elongate, straight outer sides 124 and 126 and elongate inner straight sides 128 and 130 to encourage the vehicle 120 to glide in a line substantially parallel to the sides 124, 126, 128 and 130. In such an embodiment, the rudder or fin 132 may be optional as the configuration of the vehicle 120 contains inherent self-righting properties to maintain the trajectory of the vehicle 120 along the longitudinal axis of the strut 134.

Figure 6:
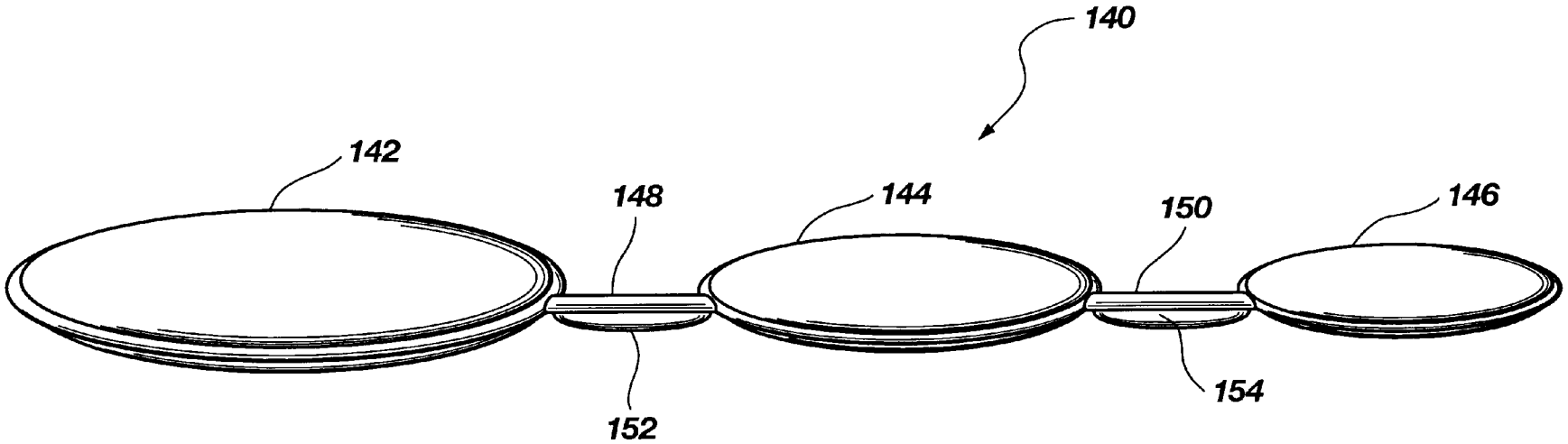
FIG. 6 is a perspective view of a sixth preferred embodiment of a vehicle in accordance with the principles of the present invention.

The vehicle, generally indicated at 140, shown in FIG. 6 is comprised of a plurality of saucer shaped members 142, 144 and 146 interconnected with elongate connecting members 148 and 150 each having a generally cylindrical shape. A pair of lateral stabilizers 152 and 154 are attached to the connecting members 148 and 150, respectively. Each of the saucer-shaped body members 142, 144, and 146 have different diameters with the saucer-shaped member 142 having_the largest diameter, and the saucer-shaped member 146 having the smallest diameter. The vehicle 140 is capable of traveling in a direction parallel to its longitudinal axis. More specifically, for example, when submerged in water and being comprised of a lighter than water material, the vehicle 140 will be encouraged to glide under water in a direction toward the largest body member 142 as the_ buoyance of the vehicle 140 is greater proximate the largest body member 142. The rise of such a vehicle will obviously depend upon the respective buoyancy of the body members 142, 144 and 146.

Figure 7:
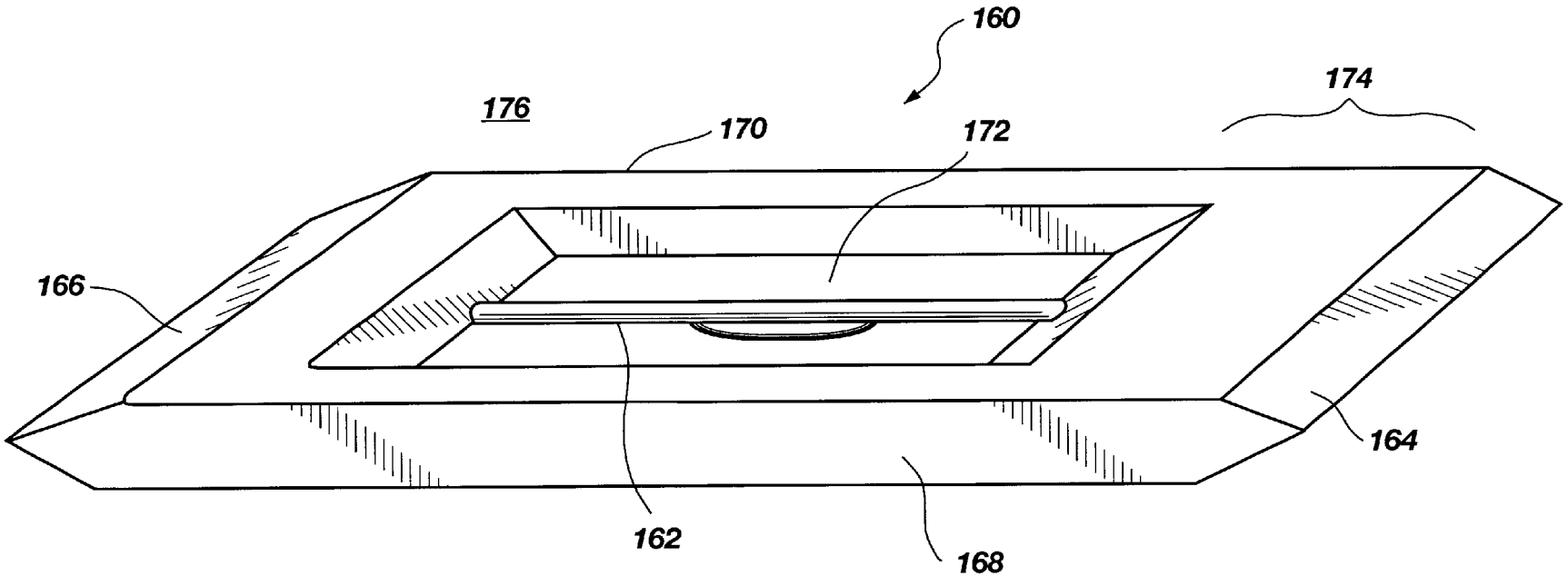
FIG. 7 is a perspective view of a seventh preferred embodiment of a vehicle in accordance with the principles of the present invention.

FIG. 7 illustrates yet another preferred embodiment of a vehicle 160 in accordance with the present invention. The vehicle 160 is similar in configuration to the vehicle 120 illustrated in FIG. 5 but having a more box-like, rectangular configuration. Such a vehicle 160 is encouraged to travel substantially in line with the longitudinal axis of the center strut 160 as the aerodynamics of the vehicle 160 include fore and aft tapered ends 164 and 166, respectively, as well as, among others, flat sides 168 and 170. As illustrated, the vehicle 160 is provided with a center aperture 172 that is longitudinally offset from the center of the vehicle 160. More specifically, the aperture 172 is positioned closer to the aft end 166 of the vehicle 160 to define a larger body portion 174 proximate the front end 164 of the vehicle 160 with a corresponding smaller portion 176 proximate the back end 166 of the vehicle 160. Depending on the buoyancy characteristics of the vehicle 160 and the medium in which it is traveling, the vehicle 160 will be encourage to rise or fall, as the case may be, such that the more buoyant end will tend to rise above the less buoyant end.

Figure 8A:
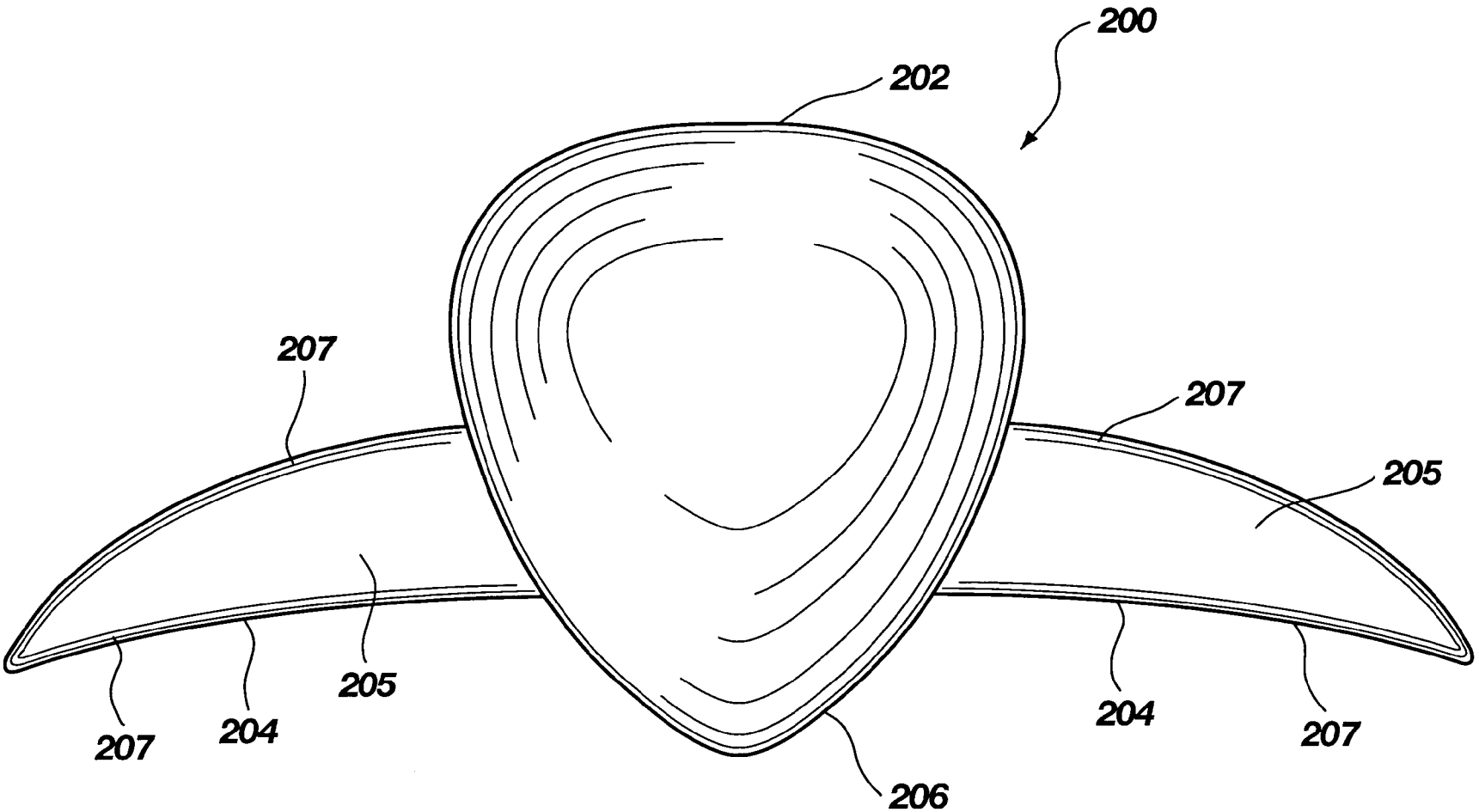
FIG. 8*a* is a top elevational view of an eighth preferred embodiment of a vehicle in accordance with the principles of the present invention.
Figure 8B:
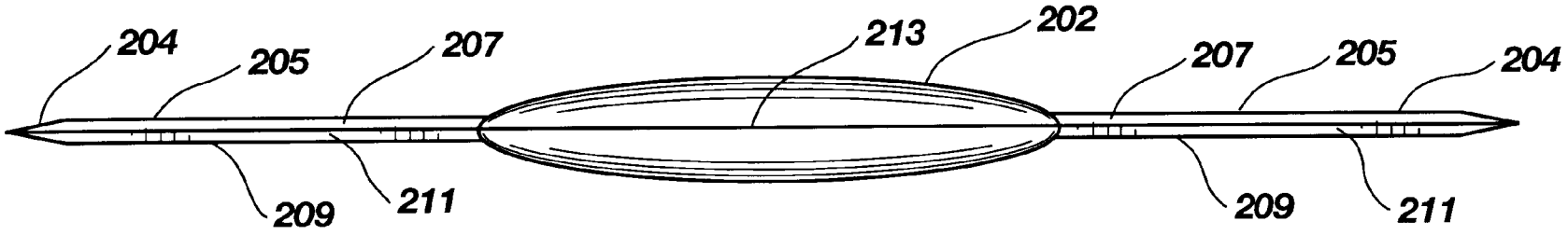
FIG. 8*b* is a front elevational view of the vehicle of FIG. 8*a;*
Figure 8C:
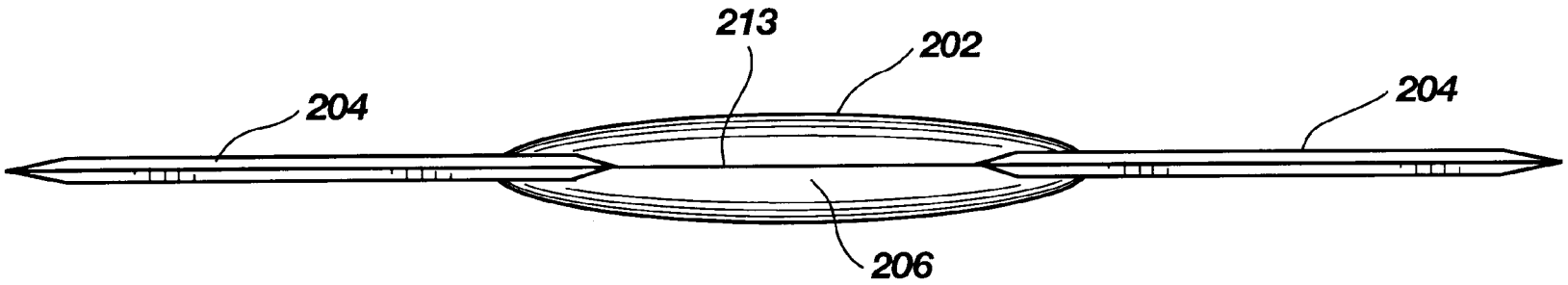
FIG. 8*c* is a back elevational view of the vehicle of FIG. 8*a;*

As illustrated in FIGS. 8*a* through 8*e,* a vehicle, generally indicated at 200, is illustrated. The vehicle 200 is comprised of a generally tear drop or guitar pick-shaped body 202 and a pair of wings 204 attached to the body 202. In this illustration, the wings are swept or curved rearwardly toward to back end 206 of the vehicle 200. The wings 204 also generally define flat top surfaces 205 with beveled_edges 207 which extends around the perimeter of the wings 204. FIG. 8*b* shows that the wings 204 define planar top and bottom surfaces 205 and 209, respectively, and tapered or beveled edges 207 and 211. The wings 204 intersect the body 202 proximate the longitudinal center line or midline 213 of the body 202. That is, the wings 204 extend outwardly from the body 202 from the center of the body 202 so that as much of the body 202 extends above the wings 204 as below. While the wings 204 generally define flat surfaces, the body 202 has a generally elliptical cross-section. As similarly shown in FIG. 8*c,* the wings 204 lie in the same plane as the midline 213 of the body 202. In addition, the wings 204 are preferably positioned closer to the back 206 of the body 202.

Figure 8D:
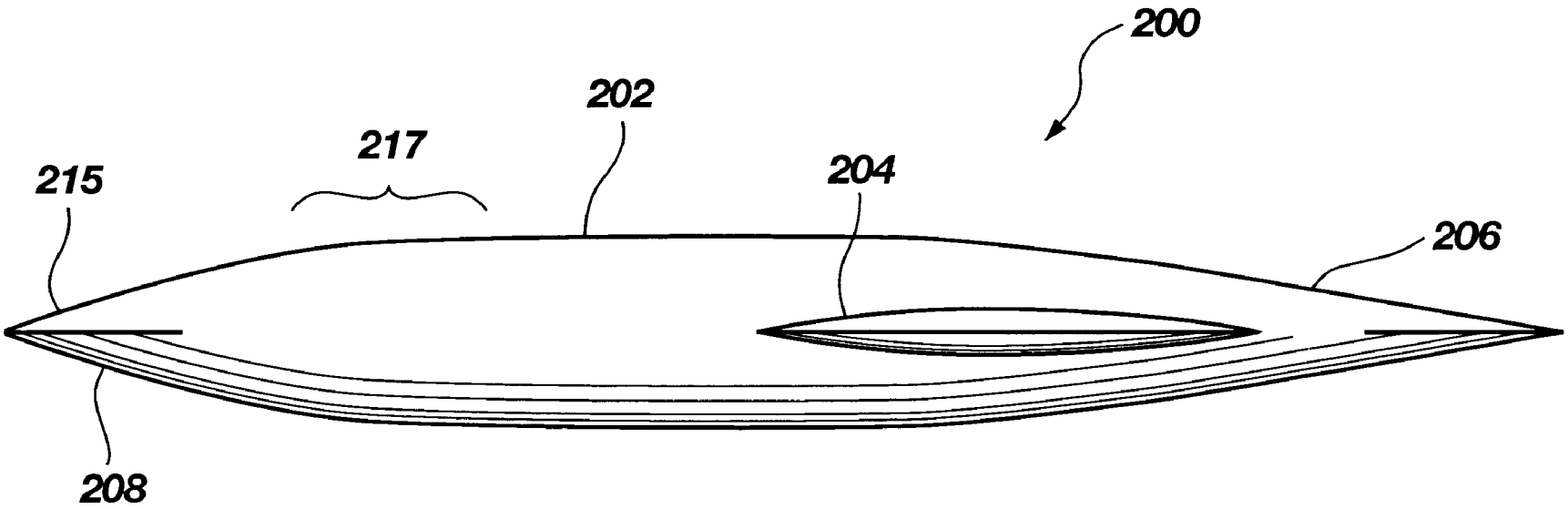
FIG. 8*d* is a side elevational view of the vehicle of FIG. 8*d;*

As further shown in FIG. 8*d,* the wings 204 may have a more gradually tapered shape. The wings 204 are positioned nearer the distal or back end 206 of the body 202 to position the center of buoyancy nearer the front of the vehicle, and thus control the rate of ascension in water. That is, because the body 202 is comprised of a buoyant material, such as a foam-like material (e.g., polystyrene, etc.) it necessarily has a tendency to rise in water. The guitar pick shape of the body 202 and having its thicker portion 217 nearer the proximal end 215 of the body 202 to position its center of gravity and buoyancy further toward the front of the vehicle 200 to further encourages the front 215 of the vehicle 200 to rise in water. The position and size of the wings 204 relative to the center of gravity of the body 202 determine the angle of attack of the vehicle as it rises in water. That is, when the vehicle is submerged in water and released, the front 215 of the vehicle 200 will tend to rise. The wings 204 try to force the vehicle 200 in a horizontal path in line with a plane defined by the upper surface of the wings 204. Because of the aerodynamic shape of the body 202 and the lack of resistance to forward movement of the wings 204, the vehicle will rapidly glide in_a forward direction while gradually ascending to the surface. Indeed, enough speed can be generated by the vehicle 200 that the vehicle can actually leap out of a body of water, such as a swimming pool, and fly onto an embankment.

The body 202 is generally wider and thicker proximate the front or leading end 215 of the vehicle 200 and includes a tapered front end 208 and a tapered back end 206. The wings 204 are generally thin and flat and are preferably secured to the body 202 at a position behind the center of gravity of the body 202. That is, the center of gravity of the wings (or more precisely the axis of rotation of the wings) is positioned behind the center of buoyancy of the body so that, in water, the center of buoyancy of the vehicle is positioned in front of the center of gravity of the wings to cause body of the vehicle to tilt upward and glide at a shallow angle in a forward direction. The wings 204 may comprise a single elongate member that is insertable through a channel transversely extending through the body 202. The wings 204 allow the buoyance of the body 202 to encourage the vehicle 200 to rise while controlling the angle of attack in the given medium.

In water and forming the body 202 from a lighter than water material, the front end 208 is encourage to rise in the water and thus propels the vehicle 200 to the surface of the water. Such propulsion is thus achieved without use of traditional means (e.g., a motor). The wings 204 keep the vehicle 200 from rising at too steep of an angle and further stabilize the vehicle 200. The swept wing arrangement 204 encourages the vehicle 200 to travel in a relatively straight path in the direction of the front end 208 of the vehicle 200. In addition, because the wings are relatively thin and flat, the wings 204 have a very low coefficient of drag thus allowing the vehicle to travel at relatively high rates of speed under water.

Figure 8E:
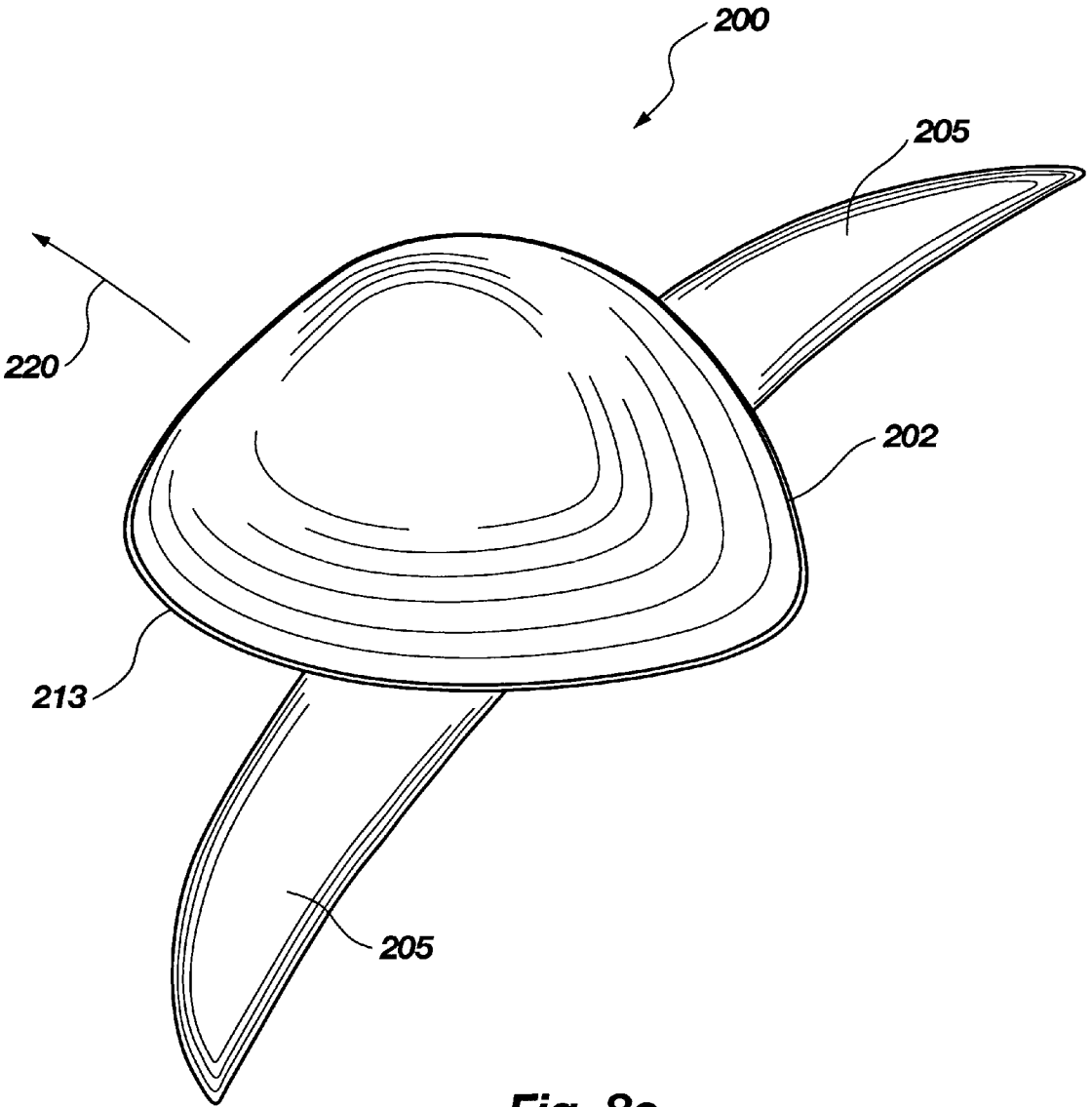
FIG. 8*e* is a perspective top view of the vehicle of FIG. 8*e;*

As shown in FIG. 8*e,* the vehicle 200 can glide under water in a direction indicated by arrow 220 which is slightly upward from a plane defined by the top surfaces 205 or the midline 213 of the body 202. In use for recreational purposes as in a swimming pool, the vehicle 200 is submerged by a user, aimed in a desired direction and released. The vehicle 200 upon release will travel or glide at a relatively rapid rate in a forward direction 220 while relatively gradually rising to the surface of the water. That is, because of the location of the center of buoyancy being at a position forward of the center of the wings, the body will tend to rise in water in a forward direction. The wings, which preferably comprise an elongate, flat member extending through the body, cause resistance to the body rising in water. Furthermore, because the wings are comprised of a relatively flat, thin segment of a relatively rigid material, such as Formica, nylon or other plastics (i.e, the wings can flex without folding, the flexing caused by the body trying to rise in the water as the wings resist such vertical movement), the wings provide little resistance to forward movement. Their upper surface area, however, resists vertical or upward movement of the vehicle.

Figure 9A:
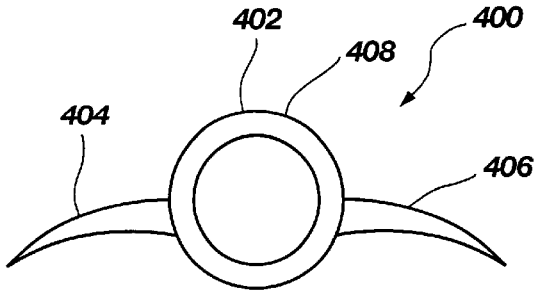
FIG. 9*a* is a top elevational view of a ninth preferred embodiment of a vehicle in accordance with the principles of the present invention.
Figure 9B:
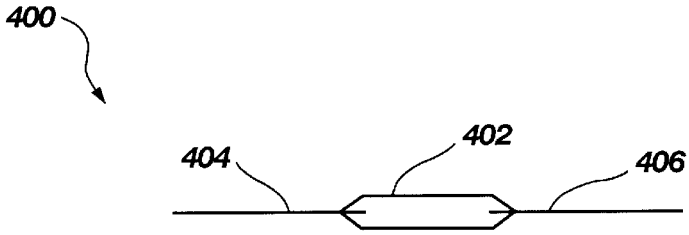
FIG. 9*b* is a rear elevational view of the vehicle of FIG. 9*a;*

FIGS. 9*a* and 9*b* illustrate another preferred embodiment of an under water gliding toy, generally indicated at 400, in accordance with the principles of the present invention. The toy 400 is comprised of a disk-shaped body 402 and a pair of rearwardly swept wings 404 and 406. The position of the wings 404 and 406 relative to the body 402 position the center of buoyancy in front of the wings 404 and 406 to encourage the front 408 to rise in water. In this preferred embodiment, the center of buoyancy is at the center of the body 402 since the body 402 is a circular, disk-shaped body with its center of gravity locate at the center of the disk 402. As such, the position of the wings 404 and 406 determine the angle of attack of the toy 400 as it rises in water which controls the rate of ascention and the glide characteristics of the toy 400.

Figure 10A:
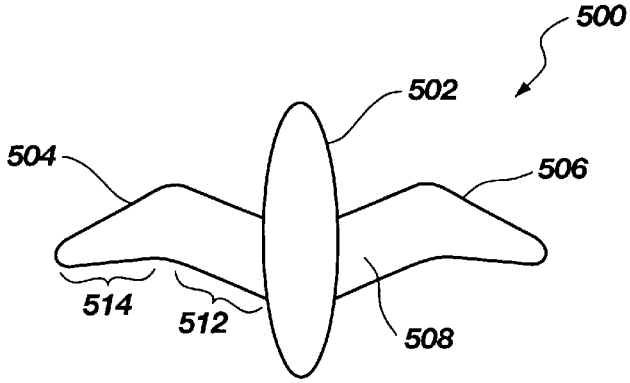
FIG. 10*a* is a top elevational view of a tenth preferred embodiment of a vehicle in accordance with the principles of the present invention.
Figure 10B:
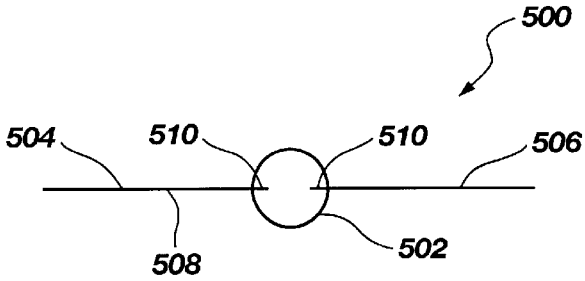
FIG. 10*b* is a rear elevational view of the vehicle of FIG. 9*a;*

FIG. 10*a* and 10*b* yet another preferred embodiment of a water toy, generally indicated at 500, in accordance with the principles of the present invention. The water toy 500 is comprised of an elliptically-shaped body 502 having a circular cross-section and a pair of wings 504 and 506 formed from a single elongate member 506 which is slid through a transversely extending slot 510 which extends from the left side to the right side of the body 502 and has a longitudinal length which substantially matches the width of the elongate member at its mid-section which is held within the body 502. This provides a snug fit between the body 502 and the elongate member 506 to resist movement of the body 502 relative to the wings 504 and 506 as the toy 500 is moving through water. The wings 504 and 506 have a rearwardly swept configuration similar to the shape of a bird, each having a first portion 512 extending in a forward direction and a second portion 514 sweeping rearwardly. As with other embodiments described herein, the position of the wings 504 and 506 relative to the body 502 control the angle of attack and thus the rate of ascension of the toy 500.

For comparison, the configuration that appears to have been Dr. Andrews' primary and most successful embodiment, named "The Aereon," might best be described as a triple cylinder vehicle, 80 feet long, 39 feet wide, 13 feet tall, each cylinder measuring 13 feet in diameter and terminating in 16 foot long, pointed and tapered ends. It was made from cambric muslin treated with varnish and filled with hydrogen. The 1864 Andrews' patent contains details regarding the interconnections of these cylinders, and means of connecting the payload, which consisted of ballast and Dr. Andrews and sometimes passengers, in a suspended car. Vast differences exist between the Aereon and the embodiments described herein.

For example, Dr. Andrews' Aereon was evidently balanced laterally by virtue of a sidewise torquing moment towards a horizontal position. This created a righting action such as ordinarily found in flat horizontal floating objects, submerged or on the surface, as can be observed by pressing and releasing the corner of a flat board in water.

The embodiments of the present invention exhibit self-righting properties too. Further, they allow for deliberate horizontal shifting of the center of gravity as a means for modifying the ship's lateral position. This affects the travel of the vehicle in the medium and can be used to "slide the ship sideways," as it were, either up or down as may be useful in given situations. Straight vertical ascents and descents can also be accomplished, by aligning the vehicle in a vertical plane and providing positive or negative buoyancy. Through proper lateral adjustments, made in conjunction with other alterations discussed below, the maneuverability of a hummingbird may ultimately be obtained in more sophisticated embodiments.

Ballast mechanisms have been developed in the dirigible industry that involve pumping water to various parts of the ship. Similar means for ballast control exist in submarines. The present invention does not articulate improvement in these mechanisms or methods, but advocates their incorporation as one means to effect desired angulation of the ship in any given direction, laterally or fore-aft, or combination thereof. Gas density changes in different parts of the ship or shifting of lifting gas through pneumatic pumping would also bring about desired angulations of the ship, as will mechanical shifting of the center of gravity, further discussed below.

As the preferred embodiments travel through a viscous medium, their resistive surfaces experience a dynamic pressure against them, as does any body moving through a viscous medium. Greater velocities produce greater dynamic pressures. The size of the area exposed affects total pressure, larger areas experiencing greater total pressure. These surfaces, viewed as "resistive to fore-aft torquing" in this context, are also "reactive surfaces" in that they oppose vertical movement by physically reacting against the medium and creating lateral propulsion—as per the yardstick example given above, and as further described in the Andrews' patent.

These pressures help stabilize the angle of ascent or descent by mitigating against fore-aft torquing, and the accompanying "zig-zag" path, such as that taken by a free-falling sheet of paper. It has been necessary to balance the relative size of the resistive surfaces of these embodiments through trial and error for each particular configuration, with continued experience aiding the endeavor. Small wing forward or "canard" arrangements generally, but not always, work best to this end.

The relative upward or downward torquing of these surfaces in opposition to each other, through the body of the vehicle, greatly improves directional stability and vehicular attitude. Indeed, there appears to be a resistive torquing center at any given velocity, which must operate in harmony with the fore-aft centers of buoyancy and gravity. While such torquing eludes obvious analysis, resistive surface fore-aft balancing has consistently been critical to performance, either through relative size of independent buoyancy chambers, as can be seen in several drawings, or through flat wing-like surfaces in fore and aft positions, also shown in the drawings.

The embodiments herein are more streamlined and proportionately thinner than the Aereon, with length to thickness or "fineness ratios," in excess of 6.2 to 1; these embodiments, for example, may have fineness ratios three or four times that of the Aereon. They also offer less resistance to forward movement than the Aereon, by virtue of not possessing triple hulls or an extensive complex of netting, dangling ballast, and web of ropes to support ballast and car below. These embodiments thus "slice through the air" more readily than configurations like the Aereon—much as a sharp knife will cut more smoothly than a dull knife, or as a thin keel will create less drag than a thick one.

More streamlined and sleeker embodiments clearly create less drag proportionately than did the Aereon, other factors being equal. Still, the Aereon travelled at 140 to 200 miles per hour, with 200 pounds of lift, according to Andrews and others. Such speeds are consistent with the terminal velocity of sailplanes, parachute jumpers, windmills, and iceboats. Yet the preferred embodiments of the present invention have, proportionately, done better than Andrews reported, as measured by speed per unit of lift.

One helium model, for example (two saucers linked in the same plane), consistently accelerated to an estimated 10 miles per hour. This was achieved with 8 ounces of lift, improving by a factor of 20 the velocity per unit lift reported by Andrews. These results have been confirmed in observations of other embodiments as well.

The streamlined nature of this invention yields less susceptibility to local turbulences too. For example, even small working water models are scarcely diverted in their line of travel by swift jets of incoming water in swimming pools. Hindrances caused by nonstreamlined ropes, wires, exposed upright passengers, etc., have long been studied and condemned by the aviation industry.

Cross sectional views in Andrews' patent of the Aereon, along with the text, indicate that the downsloping and upsloping surfaces of the Aereon's outer hulls along its eighty foot length—like the hulls of submarines, whose occupants traditionally claim rise all too rapidly—did not contribute to resistance in vertical directions; but at the same time, such surfaces contribute unnecessarily to drag, and hence, reduction in terminal velocity.

The preferred embodiments improve on Andrews' type vehicles in at least three ways, as a means to gain relative vertical resistive surface area. First, they employ more rectangular-tending cross-sectional profiles, with larger dorsal and ventral flat resistive surface areas, as may be promptly deduced from the drawings. Second, they incorporate thin strong wings of minimal thickness, similar to those used in hang gliders, but flatter and proportionately larger. Third, they utilize combinations of these arrangements. Such vertical resistive surface gain is not difficult to obtain, given today's engineering and strong lightweight materials. The drawings are self-explanatory regarding these arrangements.

In submarines, where lift is not so much a concern, the added space from a rectangular-tending hull becomes usable space, which helps mitigate the traditional problem of cramped quarters in submarine architecture. Again, the drawings are self-explanatory regarding such arrangements.

Andrews claimed that, "To navigate the air with this vessel, it is only necessary to step to the rear end of the car, thus elevating the bow five to ten degrees, and by throwing out a little ballast she will go ahead on the ascending plane." A five degree angle yields a glide ratio of about 9 to 1.

The ability of an Andrews-type DCV to descend and ascend at shallow angles is paramount to its commercial utility and success. But the shallower the angle the trickier the balancing of forces involved Many "see-saws" of interrelated variables come into play, such as fore-aft torquing, the ratio of vertical to lateral resistance, and magnitude of positive or negative buoyancy. A major feature accounting for consistency and flatness of flight in the preferred embodiments has been the relative total area flatness or "flat-tendingness" of dorsal and ventral surfaces of the vehicles. As used herein, "flat-tendingness," or tendency toward flatness, is intended to describe "large flattish surfaces," such as might be found on a slightly domed saucer or slightly bowed plate. As To avoid verbosity, "flat" and "flattendingness" are used interchangeably herein.

The preferred embodiments of the present invention surpass Dr. Andrews' designs. Indeed, none of the preferred embodiments utilize the longitudinal cavities which Andrews claimed to be "he most important feature in the construction of this machine." Such cavities contribute only undesired surface area, and contribute to drag and weight. This could explain why glide ratios of the preferred embodiments have been on the order of 15 to 1 and greater.

In the Aereon, and traditionally in the dirigible industry, buoyancy has been controlled at least in part through dispensable ballast and venting of gasses. Submarines operate similarly, with the assistance of compressed air and addition or subtraction of water from the ship's hull. Recognizing advantages and disadvantages for different means of buoyancy control, the present invention only cites illustrative possibilities, supporting an open approach regarding various means including but not limited to: pumping air in and out of a fixed volume chamber; direct pumping of lifting gas into a compressed state, alternating with release to a decompressed state; pressurized air bladders in fixed volume hulls; venting and/or chemical generation of hydrogen; heating or cooling of lifting gas through utilization of ambient temperature differences, heat exchangers, solar heating, ventilation, or other means; water ballast; and mechanical changes in vehicular shape to effect compression and decompression.

It should be noted that the vastly reduced resistance of the preferred streamlined embodiments necessarily translates to much higher velocities per unit of lift or sink due to drag reduction and to the amount of density change required for propulsion or movement over a given distance. That is, a given density change will move preferred embodiments much further and faster than a given density change in the Aereon would have moved it. Given that LTAs eliminate the vast energy needed by HTAs to produce dynamic lift in the first place—even an LTA with as much drag as the Aereon does not consume energy for dynamic lift—this fact is of profound significance in regard to energy savings.

The only directly variable resistive surface on the Aereon was its triangular muslin rudder, shaped with bamboo and controlled by various cords. At seventeen (17) square feet, the rudder was considered "abundantly large," and oversteering was to be guarded against, lest the ship travel "in undesired circles."

Dorsal and ventral resistive surfaces of the Aereon, of course, were controllable indirectly through the shifting of weight. As Dr. Andrews noted, "When she has ascended as high as the aeronaut wishes to go, he opens one of the valves and discharges some gas, at the same time stepping toward the forward end of the car, which will depress the bow, elevate the stern, and so change the angle of inclination, when she will go ahead on the descending plane. On a near approach to the earth he has only to step to the middle or rear end of the car, and thus elevate the bow. To stop her momentum at any rate of velocity, sail horizontally for a short distance, or throw out more ballast and go ahead again on the ascending plane. Having forward motion, she is turned by the rudder just like a boat on the water. Stern way may also be had if desired."

The angulation of the preferred embodiments in commercial form would come from ballast, buoyancy, and center of gravity shifts, in addition to traditional control surfaces as necessary in particular embodiments. Such shifts alone create pronounced turning moments in air and water embodiments—as Dr. Andrews noted whilst walking fore and aft in the Aereon. The lateral weight shifts possible in commercial embodiments of this invention may eliminate the need even for a rudder. By mechanically shifting the center of gravity laterally in air and water embodiments, prompt turning moments in the flight path have been observed, with the vehicle banking toward the left or right.

Indeed, one purpose of this invention is to reduce or eliminate to the extent possible the inherent drag of traditional control surfaces, such as fins, rudders, stabilizers, and ailerons, even though some such surfaces may be required for fine-tuning or maintaining fine control over movement.

Embodiments that utilize distinct fore and aft chambers are highly controllable in terms of directionality, when means are provided to vary the relative angulation of the chambers to each other. For example, in two saucers linked together in the same plane, each chamber acts as an airfoil that can bank the vehicle, send it up or down, or bring it to a stop, much as Andrews did in landing the Aereon. The wings of the vehicle 10 in FIG. 1, if maneuverable, have a similar effect. Tensioning and de-tensioning of fabric wings in larger embodiments should also aid maneuverability, based on observations of several models and technology from the sailboat and hang gliding industries.

The use of new materials and their advantages in terms of light weight and high strength have been mentioned herein. Such materials may be employed to reduce the ship's inertia and increase the vehicle's acceleration. Such materials may include aircraft aluminum or carbon fiber for the ship's internal framework. In addition, the ability to absorb shocks from turbulence, to hold together under adverse conditions, and to climb to greater heights with lower volumes of lifting gas will be improved by utilizing such lightweight yet relatively strong materials.

Density changes that depend on pressurized gas envelopes, mentioned earlier, and strengthening the skin of the vehicle will allow for increased flexibility unimaginable in Andrews' time. New coverings such as the tough, durable fabrics now used on sailboats should yield enormous drag reduction compared to that of the Aereon, which alone could account for significant increases in velocity. Such fabrics are also what make gross changes in the ship's form—with attendant density and buoyancy change—a realistic consideration. Gas retention will be vastly improved, hopefully to the point that little or no lifting gas is lost or diluted.

The use of Heptax 525 and nylon based Mylar—both materials weighing less than one ounce per ten square feet—has enabled the production of small models in accordance with the present invention that were impossible to make in Andrew's day. Indeed, the aforementioned India-rubber model was specially made in Paris. Until then, Andrews had been unable to construct a small working model, due to the high relative surface area and weight inherent in small models.

These profound material improvements create a radically advanced construction environment that lends great feasibility to the new arrangements discussed herein and the present invention is intended to cover the usage of all such materials known in the art.

Aereon apparently suffered from center of gravity shifts which did not "preserve the bottom nearest to a perpendicular line extending through the center of gravity" at various angles of inclination. This somewhat ambiguous statement appears after much discussion in the Andrews' text regarding centers of gravity and optimal location for a resistive surface on a balloon.

According to both his patent and various reports, Andrews went so far as to build and fly lemon-shaped embodiments which kept the center of gravity more properly in line with the center of buoyancy, even though he does not specifically make reference to the center of buoyancy.

The preferred embodiments incorporate their payload in the plane of the vehicle in ways that reduce air friction, as shown in the drawings. Such arrangements also allow for incorporating means to shift the payload automatically—for example, through pneumatic or hydraulic sliding devices not even available in the last century—and thereby present another responsive means to alter the vehicle's center of gravity. Since such arrangements do not create a wide disparity between center of gravity and center of buoyancy, as the Aereon did, these embodiments do not suffer from these centers opposing each other in a disequilibrating manner, with opposition of angulation to the plane of travel.

Additionally, the long structural connections between the fore and aft gas chambers of some of the preferred embodiments, in conjunction with weight shifting mechanisms, allow more latitude for weight shifting than did the Aereon, that was limited to the length of the car which passengers walked back and forth in.

While a mathematical formula for all the forces at work in the operation of the preferred embodiments, it may be stated that a multitude of forces operate on any DCV in conjunction with each other. These include at a minimum:

a. the ship's center of gravity;

b. the ship's center of buoyancy;

c. the vehicular metacenter in both fore-aft and lateral directions;

d. resistive surface friction and turbulence effects in vertical, horizontal, and angled planes, which may vary at different velocities;

e. the shape of forward penetration surfaces near the bow of the vehicle;

f. gross linear profile, which may ultimately be shown to be as critical to DCVs as they are to fish or dolphins;

g. configuration of the vehicle as it relates to the "back-filling" of air and turbulence effects associated with it;

h. wing loading per unit area, which in my embodiments is a small fraction of traditional figures for HTA vehicles, measurable in square feet per ounce (as opposed to pounds per square foot);

i. relations between length, width, thickness, and "roundedness" of the vehicle or portions thereof;

j. total amount of flat or flat-tending dorsal and ventral surface areas;

k. positive and negative buoyancy in relation to overall mass, shape, and volume;

l. the ship's ability to right itself into the wind.

Further research and development will ascertain optimal mixes and control of these variables for different purposes. However, the embodiments shown in the drawings and described herein vastly improve the results obtainable in the Aereon, and present a foundation for further refinement as these influences relate to development of commercial DCVs. The preferred embodiments enhance the possibilities for independent maneuvering of these variables, ranging from such a small alteration as changing a wing on the embodiment shown in FIG. 1, to ascertain the effects thereof, to expanding that same embodiment into a commercial form that will carry passengers or cargo from continent to continent, or perhaps drift for years through the carbon dioxide of Venus, or behave as modified submersibles for exploration of the oceans.

Thus it can be seen that a DCV constructed with properly resistive surfaces as described provides an excellent alternative to traditional DCV designs, in ways that would be of great benefit to the technological progress and global standing of our nation. Only a small amount of energy is required to move such a vehicle and its payload through a given medium, that energy being the amount needed for compression and decompression, as the DCV slides smoothly and noiselessly onward through shallow, gentle curves in a chosen direction. The motion of the vehicle is a function of pronounced resistance to vertical movement, in conjunction with a relative lack of resistance to lateral movement, and derives from the vehicle's flat surface reaction against the medium, that in turn is a result of positive or negative buoyancy.

While the above description contains many specifics, these are not meant to limit the scope of the invention, but to illustrate presently preferred embodiments and show particular relationships, factors, or arrangements for consideration, refinement, and manufacture.

While various preferred embodiments are shown in the drawings, a large number of thin profile vehicles with broad resistive and reactive vertical surface areas, upon proper balancing and weighting for ascent or descent, have worked to accomplish the primary objects of this invention. Accordingly, the scope of the present invention should be determined not by the embodiments illustrated, but by the appended claims and their legal equivalents.

What is claimed is:

1. A water toy capable of gliding under water at a relatively shallow angle, comprising:

an aerodynamically streamlined body having a density less than water and defining a center of buoyancy, said body having a guitar pick shape defining a wider front portion and narrowing to a back end thereof;

a right laterally extending wing and a left laterally extending wing, said right and left wings coupled to said body and oriented to resistance vertical movement of the body while providing relatively little resistance to forward movement of the body.

2. The toy of claim 1, wherein said first and second wings are formed from a single elongate member and said body defines a transversely extending slot extending through said body, said slot configured to receive said elongate member therein so that said first and second wings extend from said body.

3. The toy of claim 1, wherein said first and second wings sweep in a rearward direction.

4. The toy of claim 2, wherein center of buoyancy of the body is positioned forwardly of a center of rotation of the elongate member.

5. The toy of claim 1, wherein said right wing comprises a substantially flat, and relatively thin wing and said left wing comprises a substantially flat, and relatively thin wing, said right and left wings each defining a substantially flat top surface and a substantially flat bottom surface, said top and bottom surfaces being substantially parallel to each other.

6. The toy of claim 1, wherein said body defines a cross-sectional area that is larger nearer the front of the body and smaller nearer the rear of the body.

7. The toy of claim 1, wherein said body is formed from a foamed material.

8. The toy of claim 7, wherein said wings are formed from a plastic material.

9. The toy of claim 1, wherein said right and left wings are positioned relative to said body to encourage said body to glide at a relatively shallow angle toward the surface of the water.

10. The toy of claim 1, wherein said right and left wings are attached to said body behind the center of buoyancy of said body.

11. The toy of claim 1, wherein said right and left wings are attached to said body proximate a midline of said body.

12. An underwater glider, comprising:

an aerodynamically streamlined body having a density less than water and defining a center of buoyancy, said body having a disk-like shape; and a right laterally extending wing and a left laterally extending wing, said right and left wings coupled to said body and oriented to resistance vertical movement of the body while providing less resistance to forward movement of the body, said center of buoyance positioned in front of a center of rotation of the wings to encourage forward movement of said body through water.

13. The glider of claim 12, wherein said first and second wings are formed from a single elongate member and said body defines a transversely extending slot extending through said body, said slot configured to receive said elongate member therein so that said first and second wings extend from said body.

14. The glider of claim 12, wherein said first and second wings sweep in a rearward direction.

15. The glider of claim 12, wherein said right wing comprises a substantially flat, and relatively thin wing and said left wing comprises a substantially flat, and relatively thin wing, said right and left wings each defining a substantially flat top surface and a substantially flat bottom surface, said top and bottom surfaces being substantially parallel to each other.

16. The glider of claim 12, wherein said body defines a cross-sectional area that is larger nearer the front of the body and smaller nearer the rear of the body.

17. The glider of claim 12, wherein said right and left wings are positioned relative to said body to encourage said body to glide at a relatively shallow angle toward the surface of the water.

18. The glider of claim 12, wherein said body is formed from a foamed material.

19. The glider of claim 18, wherein said wings are formed from a plastic material.

* * * * *